US010260756B2

(12) United States Patent
Dänzer et al.

(10) Patent No.: US 10,260,756 B2
(45) Date of Patent: Apr. 16, 2019

(54) DEFLECTING ELEMENT FOR APPLIANCE DOORS

(71) Applicant: Electrolux Home Products, Inc., Charlotte, NC (US)

(72) Inventors: Stefan Dänzer, Wettringen (DE); Stefan Bayerlein, Feuchtwangen (DE); Magdalena Moll, Geslau (DE)

(73) Assignee: Electrolux Home Products, Inc., Charlotte, NC (US)

( * ) Notice: Subject to any disclaimer, the term of this patent is extended or adjusted under 35 U.S.C. 154(b) by 385 days.

(21) Appl. No.: 15/160,334

(22) Filed: May 20, 2016

(65) Prior Publication Data

US 2017/0336077 A1 Nov. 23, 2017

(51) Int. Cl.
*F24C 15/02* (2006.01)
*F24C 15/04* (2006.01)

(52) U.S. Cl.
CPC ..... *F24C 15/025* (2013.01); *F24C 15/021* (2013.01); *F24C 15/04* (2013.01)

(58) Field of Classification Search
CPC ..... F24C 15/021; F24C 15/025; F24C 15/04
USPC ..... 126/21 R
See application file for complete search history.

(56) References Cited

U.S. PATENT DOCUMENTS 3,749,081 A 7/1973 Wilson
4,041,930 A 8/1977 Katona
4,163,444 A * 8/1979 Drouin ..... F24C 15/04 126/198
4,641,630 A 2/1987 Meister
4,716,884 A * 1/1988 Bonaccorsi ..... F24C 15/04 126/198
4,773,319 A 9/1988 Holland
5,142,125 A 8/1992 Fioroli et al.
5,361,686 A 11/1994 Koopman
5,447,145 A 9/1995 Cappello et al.
7,228,857 B2 * 6/2007 Kim ..... F24C 15/006 126/198
8,028,619 B2 10/2011 Lee et al.
8,101,891 B2 1/2012 Lee et al.
8,916,802 B2 12/2014 Bringe et al.
2006/0278214 A1 * 12/2006 Park ..... F24C 15/006 126/273 R
2007/0125760 A1 * 6/2007 Kim ..... F24C 15/006 219/391
2007/0204847 A1 9/2007 Lee et al.
2007/0267402 A1 11/2007 Harned et al.
2008/0184985 A1 * 8/2008 Hasslberger ..... F24C 15/006 126/21 R (Continued)

*Primary Examiner* — Avinash Savani
(74) *Attorney, Agent, or Firm* — Pearne & Gordon LLP

(57) ABSTRACT

A deflecting element is arranged in an oven door and aligned adjacent the ventilation openings to inhibit accidental spills through the openings from fouling interior door components. The deflecting element can have a plurality of tiered blades with associated respective channels for guiding and accumulating spills. One or several of the blades can have an angled deflector portion for guiding overflow liquid to a subjacent blade, away from interior glass panels. When the oven door is rotated into an upright position, closed position, liquid accumulated in the respective channels is conducted to the lateral edges of the door, where it can be guided via ducts out the base of the door or otherwise collected in removable reservoirs.

16 Claims, 7 Drawing Sheets

(56) References Cited

U.S. PATENT DOCUMENTS

| | | | | |
|---|---|---|---|---|
| 2009/0255919 | A1* | 10/2009 | Venezia | F24C 15/006 219/399 |
| 2012/0216880 | A1 | 8/2012 | Nall et al. | |
| 2013/0319393 | A1 | 12/2013 | Harward et al. | |
| 2016/0010874 | A1* | 1/2016 | Phillips | F24C 15/006 126/198 |

* cited by examiner

DEFLECTING ELEMENT FOR APPLIANCE DOORS

BACKGROUND

1. Field of the Invention

The following description relates generally to a cooking appliance and, more specifically, to an oven range door with a deflecting element arranged inside the oven door to prevent accidental spills through the ventilation openings in the door frame from proceeding to the interior door components.

2. Description of Related Art

Conventional oven doors usually include air ventilation openings in the door frame. These ventilation openings are located on the top inside wall (facing the oven cavity) of the oven door. The ventilation openings can allow airflow through the oven door to cool the outer surface of the door when the oven is operating. The ventilation openings in the oven door may align with ventilation openings formed in the oven housing when the oven door is closed. Air can be drawn into the oven door through additional ventilation openings along a lower edge or base of the door. When the door is closed, the ventilation openings at the base can supply an air flow to the interior of the door. Air drawn into the door can flow between panels of window glass in the oven door to cool the glass. The air flow then exits via the ventilation openings in the inside wall of the oven door and through the aligned ventilation openings on the oven housing. The air can then flow through channels within the oven housing and be discharged from the oven housing.

However, when the oven door is in an open position (e.g., when the door is horizontal relative to the ground), the ventilation openings in the inside wall of the door face upward and are exposed to liquid or solid spills. Spilled liquid entering the ventilation openings has a tendency to run down the inside of the front window of the oven when the door is closed, where it can remain for the life of the appliance unless the oven door is completely disassembled and cleaned. Spilled material may also foul other internal door components and proceed between the glass panels.

SUMMARY

The following presents a simplified summary of the invention in order to provide a basic understanding of some example aspects of the invention. This summary is not an extensive overview of the invention. Moreover, this summary is not intended to identify critical elements of the invention or to delineate the scope of the invention. The sole purpose of the summary is to present some concepts in a simplified form as a prelude to the more detailed description that is presented later.

According to one general aspect, a door for a cooking appliance may be provided. The door may include a frame, an outer surface adapted to close an oven cavity of the cooking appliance, an inner surface opposite the outer surface including at least one ventilation opening in fluid communication with an air channel within the door, and a deflecting element disposed in a top portion of the frame between the inner surface and the outer surface, and aligned with the at least one ventilation opening. The deflecting element comprises a plurality of tiered blades with deflector portions and a plurality of channels. The deflector portions guide away spills received through the ventilation openings when the door is opened and the channels contain the spills when the door is closed.

In another general aspect, a cooking appliance is provided. The cooking appliance comprises an oven cavity enclosed by housing and a door for closing the housing. The door includes a frame, an outer surface adapted to close an oven cavity of the cooking appliance, an inner surface opposite the outer surface including at least one ventilation opening in fluid communication with an air channel within the door, and a deflecting element disposed in the top portion of the frame between the inner surface and the outer surface, and aligned with the at least one ventilation opening. The deflecting element comprises a plurality of tiered blades with deflector portions and a plurality of channels. The deflector portions guide away spills received through the ventilation openings when the door is opened and the channels contain the spills when the door is closed.

Other features and aspects may be apparent from the following detailed description, the drawings, and the claims.

BRIEF DESCRIPTION OF THE DRAWINGS

The invention may take physical form in certain parts and arrangement of parts, embodiments of which will be described in detail in this specification and illustrated in the accompanying drawings, which form a part hereof and wherein.

DETAILED DESCRIPTION

Figure 1:
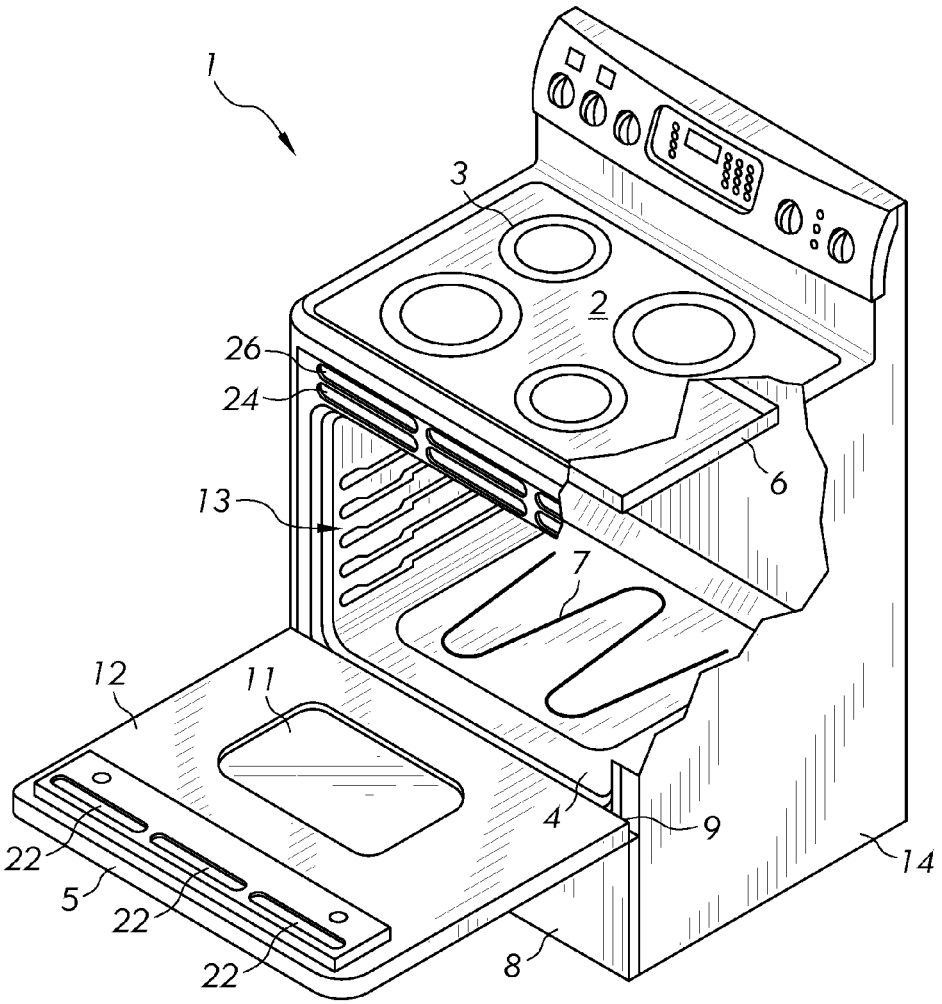
FIG. 1 is a front perspective view of an example cooking appliance shown partially broken away.

An illustrative embodiment of a cooking appliance in the form of an oven range 1 is shown in FIG. 1. The oven range 1 can be built-in, wall-mounted or freestanding, although other configurations could also be used. As shown in FIG. 1, the oven range 1 may include a cooktop surface 2 including a plurality of cooktop heating elements or burners 3 on which cooking vessels containing food items can be placed. The oven range 1 may also include a housing 14, an oven cavity 4 within the housing 14 with front opening 13, a broil element 6 and/or a bake element 7, and a door 5 for closing the oven cavity 4. The oven range 1 may also include a drawer 8 that slides outwardly to be extracted from a position underneath the oven cavity 4 to a position where the contents of the drawer 8 are accessible by a user from outside the oven range 1. The drawer 8 can be, for example, a warming drawer, a storage drawer, or a drawer having another purpose or function.

The embodiment of the cooking appliance in FIG. 1 includes both an oven cavity 4 and cooktop heating elements 3. However, alternate embodiments of the cooking appliance can include only an oven cavity 4 without the cooktop heating elements 3, and can be used in a variety of different configurations such as built-in gas ovens, etc. In addition, the oven range 1 may include more than one oven cavity 4. For example, the oven range 1 may include two cooking cavities 4 (a "double-cavity" configuration). A double-cavity configuration may be used in a built-in wall oven range, freestanding range, or other configurations. However, configurations are not limited thereto and more than two oven cavities 4 may be included in other embodiments. As shown on FIG. 1, the oven door 5 is used to close the front of the oven cavity 4. The oven door 5 is pivotally mounted to the housing 14, e.g., to a lower frame 9 of the oven cavity 4. The door 5 can be pivoted around a horizontal pivot point (not shown on FIG. 1) between a horizontal position in which the front opening 13 is open for access by the user of the appliance, and a vertical position in which the front opening 13 is closed by the door 5. The door 5 can include a window 11 for allowing the oven cavity 4 to be viewed when the door 5 is in the closed position.

The door 5 has an outer surface (not shown in FIG. 1) that faces forward (toward the user) when the door 5 is in a closed position (and faces generally downward when the door is fully open). The door 5 further has an inner surface 12 that closes the oven cavity 4 when the door 5 is in the closed position. The inner surface 12 faces generally upward when the door 5 is fully open.

As further shown in FIG. 1, the inner surface 12 of the door 5 can have one or more ventilation openings 22. The ventilation openings 22 allow air to flow through the door to cool the outer surface of the door facing the user (not seen in FIG. 1) when the oven operates. Air can be drawn into the door 5 through additional ventilation openings, e.g. along the lower edge of the door 5 (not shown in FIG. 1), and flow upward through the door to exit via openings 22 via natural convection when the oven is operating. The air passes from the ventilation openings 22 in the inner surface 12 of the door 5 into corresponding ventilation openings 24 in the oven housing 14. The air can flow through the housing 14 via appropriate ducting to cool the housing 14 and help to insulate the oven cavity 4 from the remaining elements of the appliance within the housing 14, prior to being discharged through further ventilation openings 26 in the housing 14. In addition to natural convection, mentioned above, circulating air can be pulled through the door 5 and the oven housing 14 by one or more fans mounted within the door 5 and/or the oven housing 14.

Figure 2:
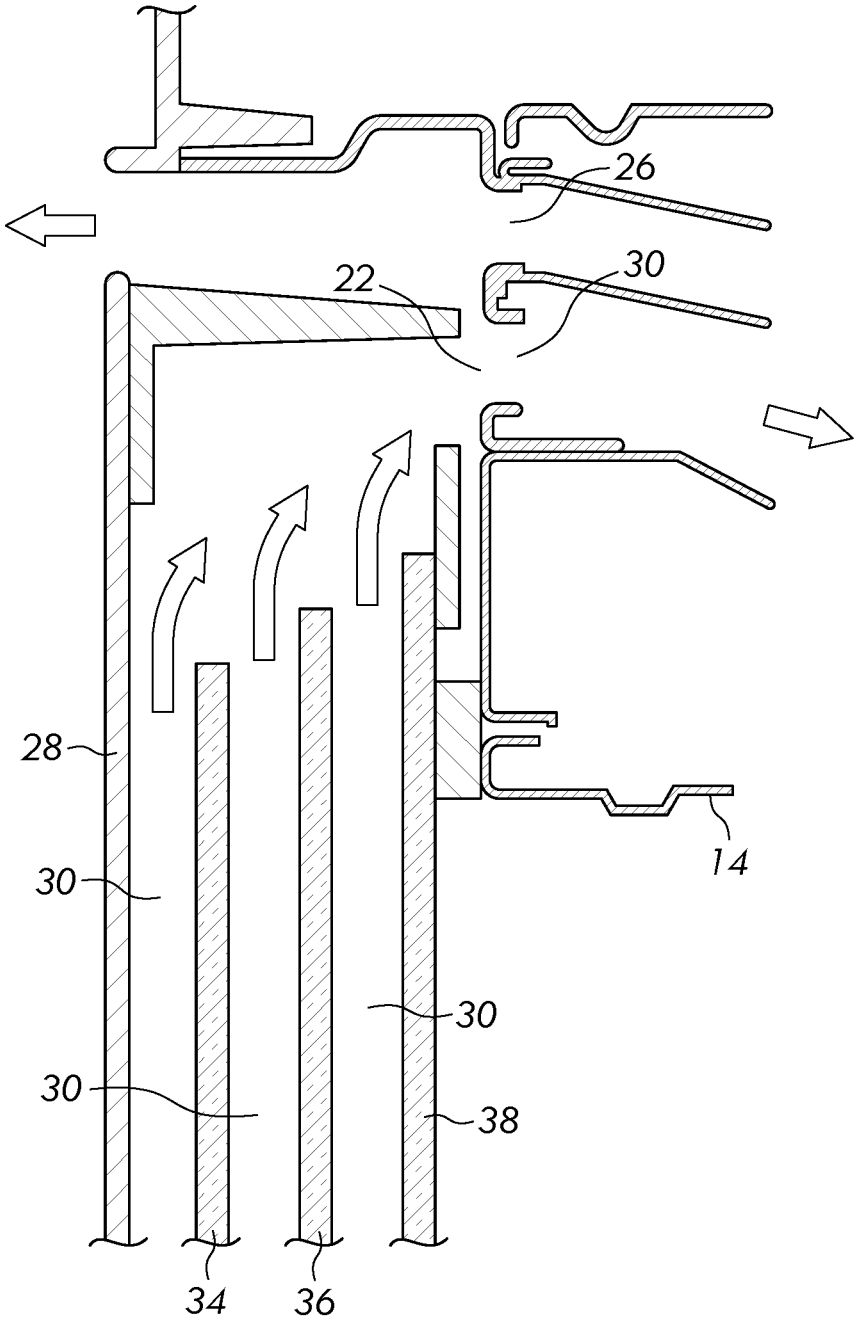
FIG. 2 is a partial side section view of the door of the cooking appliance.

A schematic illustration of an example airflow path through portions of the door 5 and the oven housing 14 is shown in FIG. 2. Air can be drawn into the door 5 by a fan in the oven housing 14. In the illustrated embodiment air enters the door 5 through ventilation openings located along the lower edge of the door or elsewhere in a lower region of the door 5. The air can flow upward within the door 5 through air channels 30 within the door 5. The air channels 30 can be formed in part by an inner surface of an outer surface 28 of the door 5 (which may be formed in part from a pane of glass; e.g. glass panel 38), the inner surface 12 of the door 5, and one or more additional interior panes 34, 36 (which may be glass panels). The ventilation openings 22 on the inner surface 12 of the door 5 and the ventilation openings in or near the lower edge of the door 5 are in fluid communication with the air channel(s) 30, which extend between them. Air flows through the air channel(s) 30 and passes out the ventilation openings 22 in the inner surface 12 of the door 5, through the corresponding ventilation openings 30 in the oven housing 14. The airflow through the door 5 can cool door components, including the outer surface 28 of the door and also various components within the oven housing 14, such as the oven control system electronics.

Figure 3A:
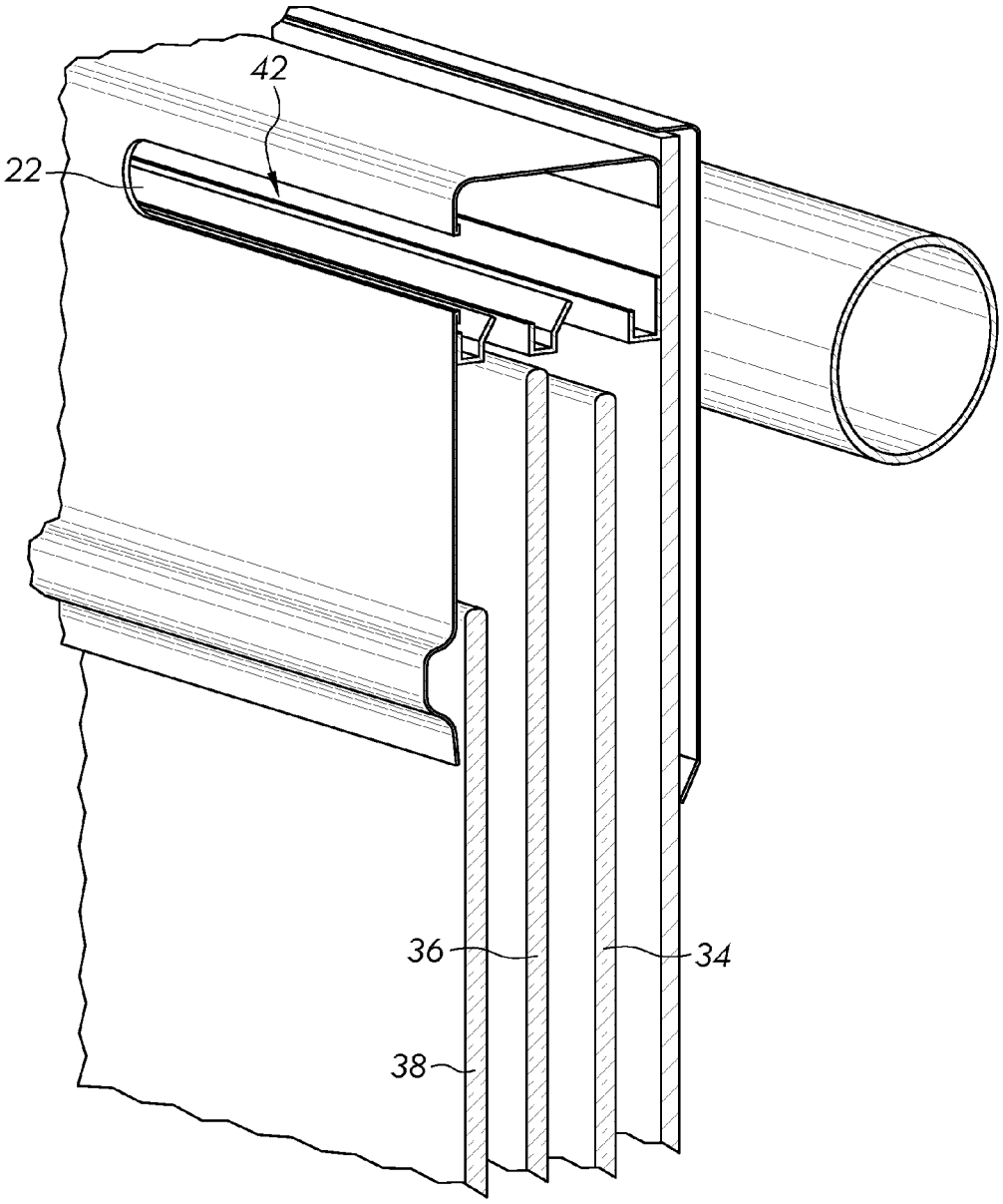
FIG. 3A is a broken-away perspective view of a portion of the door of the cooking appliance with a deflecting element installed in the door according to an embodiment, with portions of the door not shown in order to make the glass panels clearly visible.

FIG. 3A shows a broken-away rear perspective view of a "full-glass" oven door 5 with multiple glass panels (34, 36, 38), according to an embodiment. However, embodiments are not limited thereto and other configurations are possible. For example, the innermost surface 12 of the oven door 5 facing the oven cavity 4 may include an enameled steel door liner surrounding inner glass panel 38.

The glass panels (34, 36, 38) are generally made of a heat-resistant material, such as borosilicate glass, tempered soda-lime glass, or glass-ceramic, although other heat-resistant material could also be used. In an example embodiment, the glass panels (34, 36, 38) are each substantially rectangular in shape, each having two side-edge portions, an upper edge portion 48, and a lower edge portion 49. The glass panels (34, 36, 38) are supported in place relative to each other by a common support frame 47.

The glass panels (34, 36, 38) can be retained in the support frame 47 by two laterally opposed channel members (not illustrated in FIG. 3A) having respective channels each corresponding to and configured to slidingly accommodate the adjacent side edge of a respectively aligned glass panel (34, 36, 38). The support channels ensure that the glass panels (34, 36, 38) are installed in a parallel arrangement relative to each other and are spaced apart from each other at a predetermined distance to provide the aforementioned air channels 30. Depending on the number of glass panels, several intermediate air channels 30 may be provided. The intermediate air channels 30 thermally insulate the oven cavity 4 from the outside environment, so that the outer surface 28 of the oven door 5 remains cool enough to touch.

As discussed above, one problem associated with the ventilation openings 22 in the inner surface 12 of the door 5 is that food or liquids can enter the interior of the oven door 5 through the ventilation openings 22 when the door 5 is open, due to accidental spills for example. Such spills may stain the glass panels (34, 36, 38) and/or other internal components of the oven door 5 and/or cause unpleasant odors during cooking, and it can be difficult to clean the spills from the interior of the oven door 5.

To address this issue, a deflecting element can be mounted in the upper portion of the door adjacent the ventilation openings and generally above the glass panes 34, 36, 38. The deflecting element can be aligned with the ventilation openings 22 so that liquid spilled through those openings will encounter and be redirected by the deflecting element rather than drip and flow onto the glass panels. For example, spills can be guided by the deflecting element towards the lateral edges of the door frame, where the spills can remain out of sight to the consumer and be drained at a later time or via ducting to the base of the door. In this manner, the deflecting element will inhibit spilled liquid that has penetrated the ventilation openings 22 when the door is open from fouling the glass panels or other interior door structure. The deflecting element may itself have openings or otherwise be discontinuous so that air passing through channels 30 can pass through the deflecting element on its way to exit via openings 22.

Figure 3B:
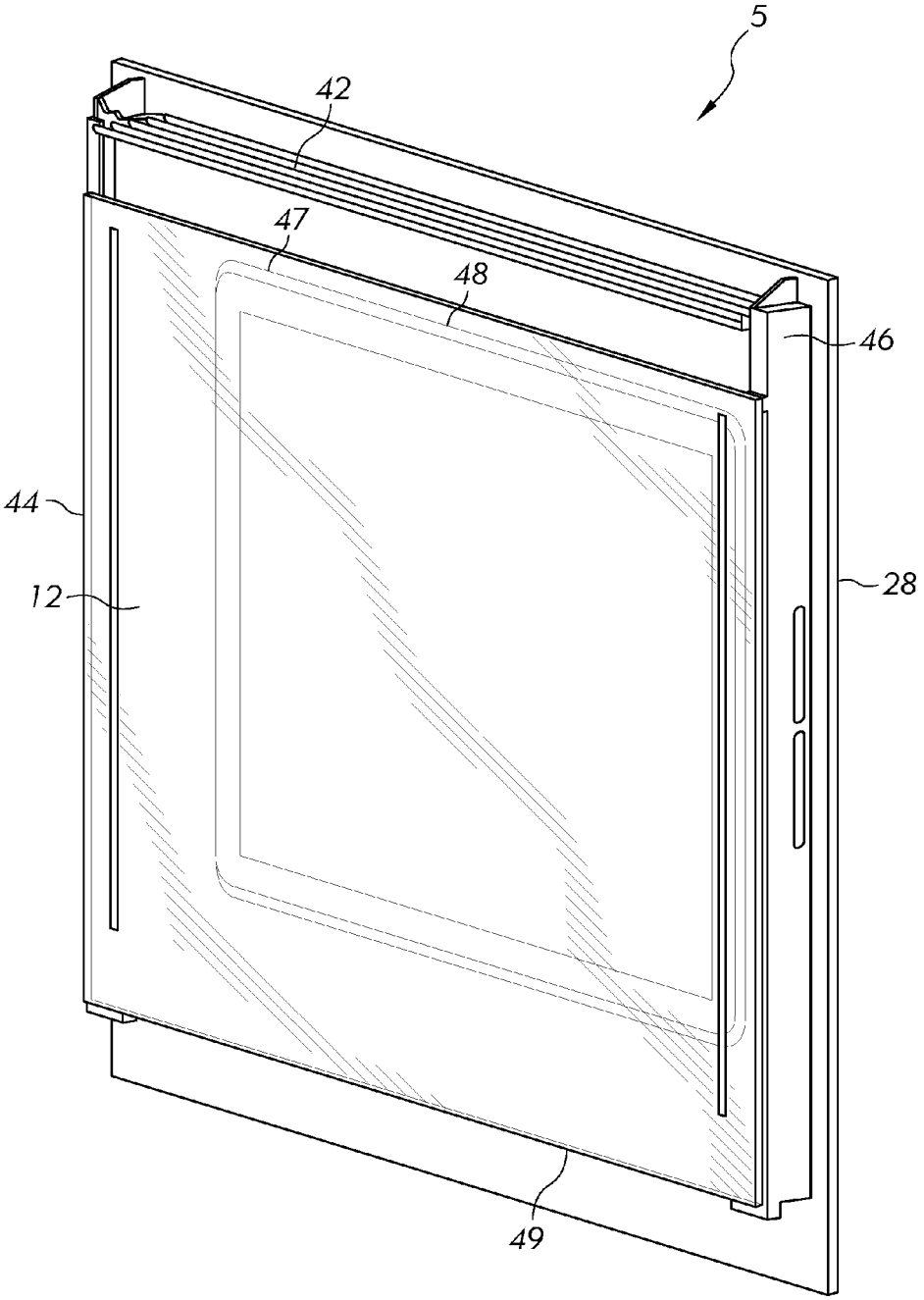
FIG. 3B is another perspective view of the door according to an embodiment.

An embodiment of a deflecting element 42 is shown beginning with FIGS. 3A-3B. In the illustrated embodiment, the deflecting element 42 is installed in the oven door 5 above the glass panels (34, 36, 38). As such, the deflecting element 42 may not be visible for the consumer. The deflecting element 42 can be fixed within the door frame via any suitable connection or fasteners; e.g. it may be snapped in place with or without the use of extrinsic fasteners. Because of its mounting location, the deflecting element 42 does not interfere with the door hinge.

Referring to FIG. 3B, the deflecting element 42 spans substantially the entire width of the door 5, from a first lateral side 44 of the door 5 (e.g., the right-hand side of the door faced by the user) to a second lateral side 46 of the door 5 (e.g., the left hand side of the door faced by the user). Turning back to FIG. 3A, the deflecting element 42 is mounted within the door frame 47 and is aligned with the ventilation openings 22.

As described below, the geometry of the deflecting element 42 inhibits spills entering via the openings 22 from contacting and fouling interior door structure, such as the glass panels.

Figure 4:
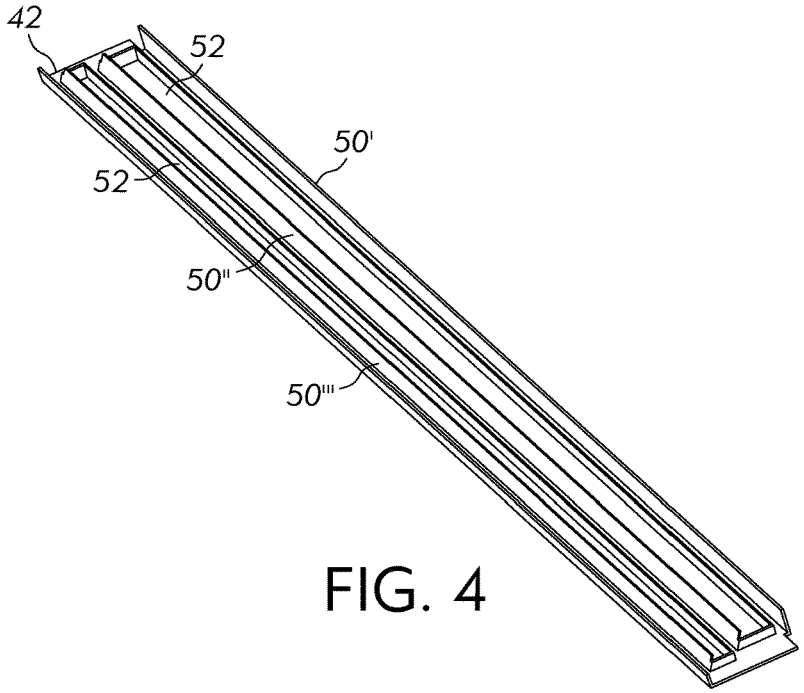
FIG. 4 is a perspective view of a deflecting element according to an embodiment.
Figure 5:
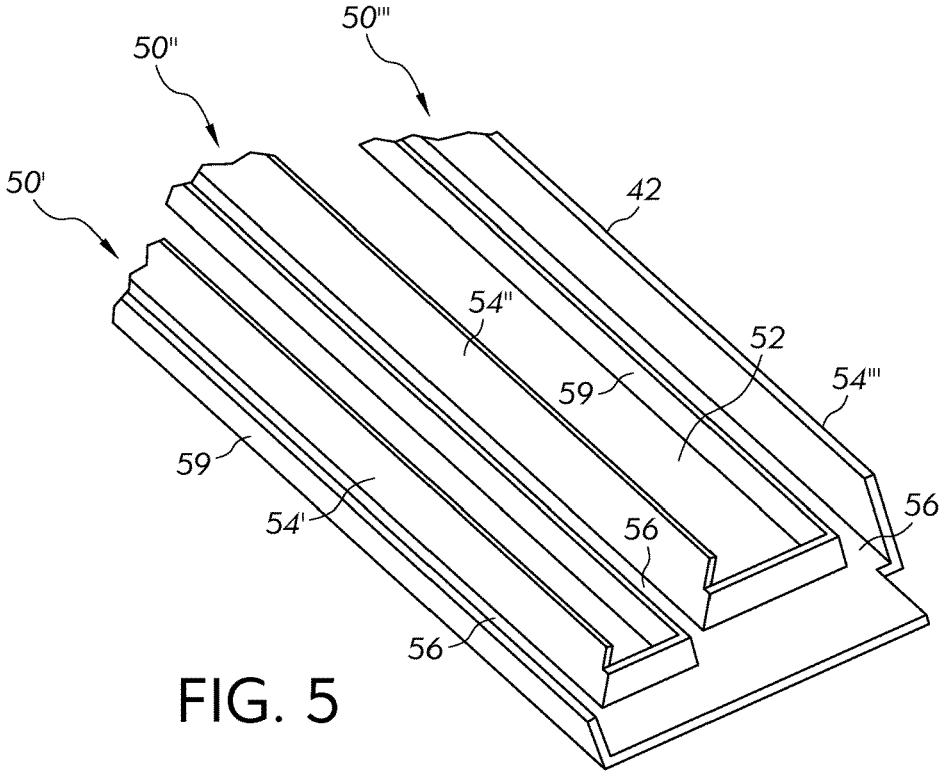
FIG. 5 is an enlarged, broken-away perspective view showing the deflecting element in FIG. 4 in more detail.

FIGS. 4-5 show enlarged views of the deflecting element 42 by itself (FIG. 5 is a close-up view). The deflecting element 42 preferably is formed as a single assembly with a width corresponding substantially to the width of the door 5. The deflecting element 42 includes openings, preferably configured as elongated slots 52, between adjacent tiered blades (50', 50", 50'"). All of the slots 52 may have the same dimensions (e.g., the same width). Alternatively, the slots 52 may have different dimensions. The slots 52 between the adjacent tiered blades (50', 50", 50'") of the deflecting element 42 are formed to correspond to the channels 30 defined between adjacent panels within the door, e.g. glass panes 34, 36, 38 as illustrated below in FIG. 7. Accordingly, the widths of respective slots 52 can correspond to the widths of the associated channels 30.

Turning back to FIGS. 4 and 5, the deflecting element 42 includes a series of tiered blades (50', 50", 50'"). FIGS. 4 and 5 illustrate a deflecting element 42 with three tiered blades (50', 50", 50'"). Three such blades are illustrated defining two elongated slots 52 therebetween, corresponding to two air channels 30 within the door 5. However, configurations with more or fewer than three blades (corresponding to two slots 52) are possible, depending on the number of glass panels (34, 36, 38), and therefore the number of air channels 30, in the oven door 5. Returning to the illustrated embodiment in FIG. 5, each of the blades (50', 50", 50'") has a deflector portion (54', 54", 54'") and a channel 56. The channels 56 are formed between the deflector portions (54', 54", 54'") of the element 42 and the side wall 59 thereof. Each deflector portion (54', 54", 54'") extends generally upward toward the top portion of the oven door (when the door is closed), thus defining a substantially U-shaped channel 56 with the side wall 59.

In a preferred embodiment (best seen in FIG. 7), the deflector portion (54', 54", 54'") have different lengths so that they extend upward different heights. For example, in a preferred embodiment the first deflector portion 54' is the shortest deflector portion, with the second deflector portion 54" being longer (taller) than the first deflector portion 54', and the third deflector portion 54'" being the longest (tallest) deflector portion, e.g., longer than both the first deflector portion 54' and the second deflector portion 54". Based on this tiered arrangement of the deflector portions (54', 54", 54'"), spilled liquids that enter the door 5 via the openings 22 will first encounter the first blade 50' when the door is in an open (horizontal) position and be conducted into the associated elongate channel 56. As the spilled volume increases, excess liquid beyond the capacity of the first channel 56 (of the first blade 50') will overflow the first deflector portion 54' and will fall by gravity to encounter the second deflector portion 54". Again, liquid will collect there, in the associated elongate channel 56 of the second blade 50", until its capacity is reached. At that time, additional spilled liquid will overflow the second deflector portion 54" and will fall by gravity to the third deflector portion 54'". On reaching the third deflector portion 54'" spilled liquid will again collect within the associated elongate channel 56 of the third blade 50'". The laterally extending channels 56 of the deflecting element 42 collect and guide spilled liquid to lateral portions of the door frame, keeping it away from other interior components of the door such as glass panes 34, 36 and 38. Meanwhile, this arrangement ensures that when the door 5 is closed, the elongate slots 52 defined between the blades 50', 50" and 50'" provide fluid communication between the air channels 30 in the door 5 and the ventilation openings 22 so that the door can be ventilated during operation of the oven.

Figure 6:
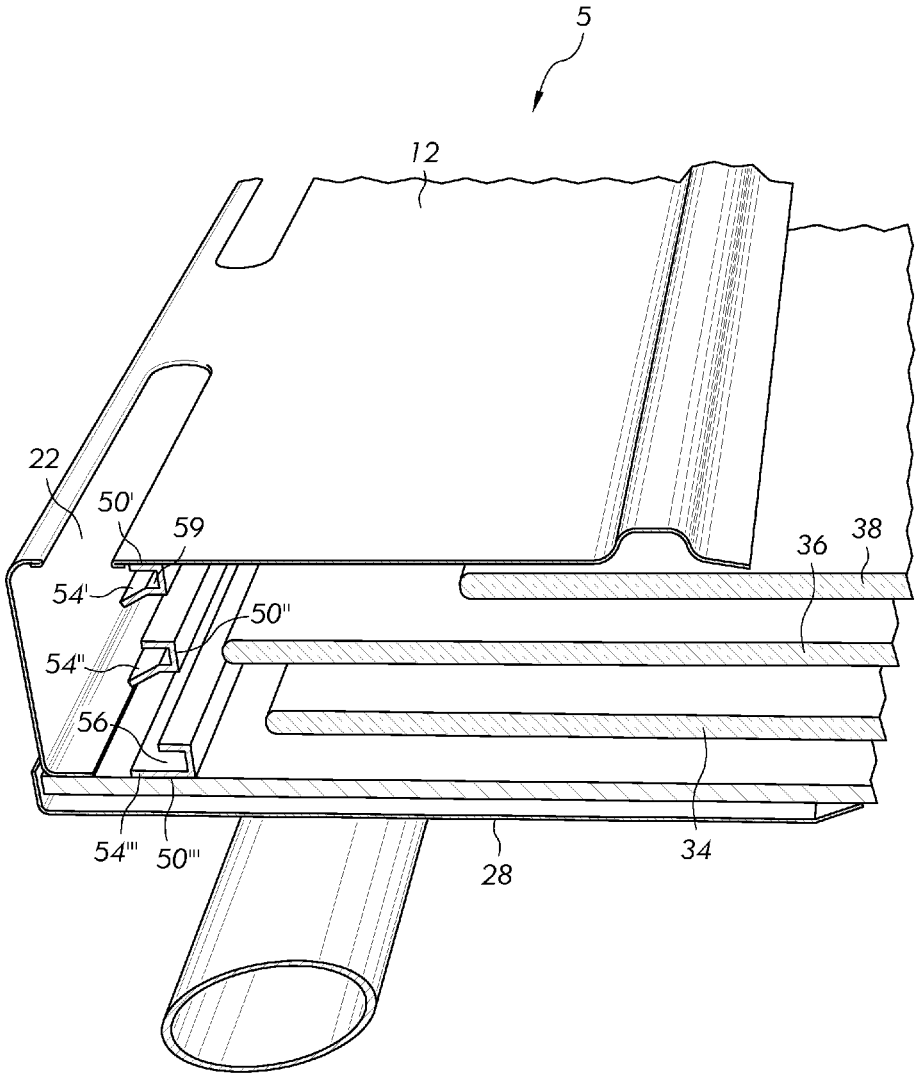
FIG. 6 is a partial perspective view of a portion of a door of a cooking appliance in a horizontal or fully open position, and having a deflecting element according to an embodiment.
Figure 7:
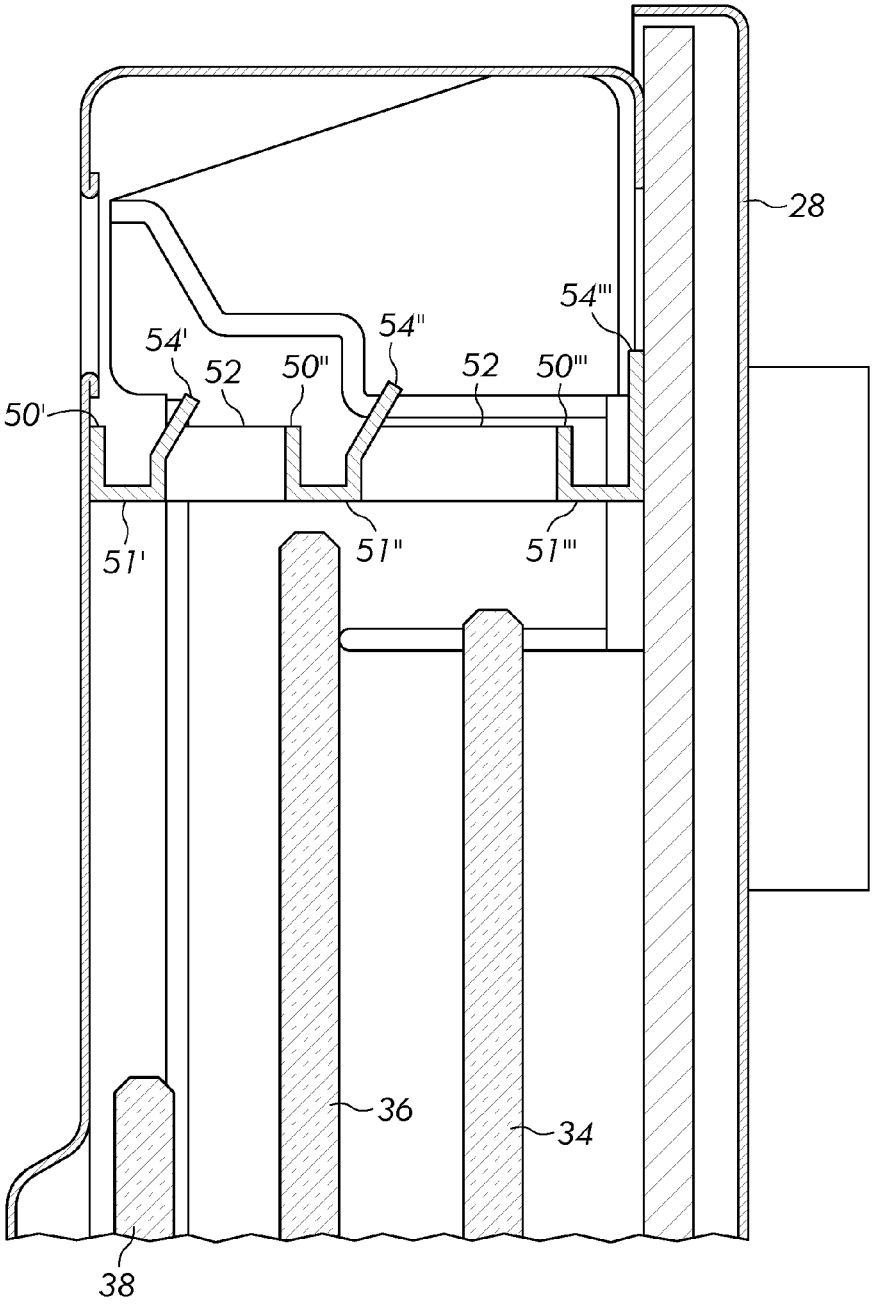
FIG. 7 illustrates a partially broken away view of an embodiment of an oven door with a deflecting element installed above the glass panels.

As seen in the figures, e.g. in FIGS. 6 and 7, terminal portions of the first two deflector portions 54' and 54" preferably are angled toward the outer surface 28 of the door 5, e.g. at an angle between 5 degrees and 75 degrees relative to an imaginary horizontal plane when the door is in a closed position and which runs generally perpendicular to the glass panes 34, 36 and 38. In this orientation, when the door 5 is in an opened position spilled liquid that exceeds the capacity of the channel 56 of the first blade 50' will be directed via the angle of the first deflecting portion 54' to the second deflecting portion 54". Likewise, the angle of the second deflecting portion will aid in directing overflow liquid exceeding the capacity of the channel of the second blade 50" to the third deflecting portion 54'". The third deflector portion 54'" need not be angled in this embodiment because it does not direct overflow liquid to a subsequent deflector element.

FIG. 6 shows a partial perspective view of a portion of a door 5 of a cooking appliance in a horizontal or fully open position with a deflecting element 42 installed in the oven door 5 above the glass panels (34, 36, 38). As shown in FIG. 6, the first two blades 50', 50" are located proximate the ventilation opening 22 at the rear face of the door 5, which faces the oven cavity (not shown). The angled deflector portions 54' and 54" are tiered, such that when the oven door 5 is open and in a horizontal position, spilled liquid encountering the first blade 50' will be directed (via the angled portion 54' thereof) to the second, subjacent blade 50", and liquid encountering the second blade 50" will be directed (again via the angled portion 54" thereof) to the third blade 50'". As illustrated in FIG. 6, due to the tiered configuration of the deflector portions 54', 54", and 54'", when the oven door 5 is fully open and in a horizontal position, spilled liquid will first encounter the first blade 50' and will be directed via the angled deflector portion 54' of the first blade 50' to the second, subjacent blade 50". Depending on the volume of the spillage, the liquid encountering the second blade 50' can be directed (again via the angled portion 54" thereof) to the third blade 50'".

Turning back to FIG. 3A, the deflecting element 42 is mounted within the door frame 47 and is aligned with the ventilation openings 22 so it is positioned in a location just below the elevation of those openings 22 when the door is in a closed (vertical) position, with the deflecting portions 54', 54", 54'" extending increasingly further into the path of the openings 22 so that liquid penetrating those openings 22 will encounter the deflecting portions on entering the door 5; e.g. via the successive dripping arrangement described above. A large portion of the ventilation openings 22 remains unobstructed by the deflecting element 42. When the oven door 5 is in a fully open position (illustrated in FIG. 6), liquid spilled through the ventilation openings 22 will encounter the first deflector portion 54' of the first tiered blade 50' and will be redirected by the deflector portions 54" and 54'" of the subjacent blades (50" and 50'"), as described above.

As shown schematically in FIG. 7, the deflecting element 42 is configured so that the slots 52 therein are generally aligned with the air channels 30 defined between panels (34, 36, 38) of the door 5. In the illustrated embodiment, the front-most slot 52 (e.g., the channel closest to the user) communicates with two such channels 30 rather than one. Accordingly, in the illustrated embodiment two of the tiered blades 50' and 50" are aligned with and positioned above each of the glass panels 38 and 36 of the door 5, respectively, thereby aligning the intermediate slot 52 in the element 42 with the innermost air channel 30.

A deflecting element 42 as herein described enables conduction of spilled liquid away from interior door panels (34, 36, 38) that may be fouled from such spills. Thus, additional structure to selectively open and close the ventilation slots 22 in order to prevent spills (such as spring-loaded pins, brackets, levers, or the like) is not required. This eliminates a degree of manufacturing complexity and cost for the door 5.

The deflecting element 42 may be made of a heat-resistant material, such as thermoplastic having a high softening point above that to which it may be exposed through operation of the oven range, although other heat-resistant materials could also be used. For example, the deflecting element 42 may be made of plastic, metal, or hybrid metal materials.

In an embodiment, the deflecting element 42 may be formed of a flexible or resilient plastic material (e.g., an injection molded plastic), such as a thermoplastic polymer like Acrylonitrile butadiene styrene (ABS), for example. As a result, the deflecting element 42 may deform against the inner surface 12 of the door 5 and the door liner, and between the two lateral sides 44 and 46 of the door 5, and expand when it is first inserted and snap back to its resting configuration once it is firmly positioned above the glass panels (34, 36, 38).

Preferably, the deflecting element 42 is formed as a separate component that may be removed for cleaning and/or replacement. That is, the deflecting element 42 in a preferred embodiment is not sealed or permanently fixed to the door frame 47, the glass panels (34, 36, 38), or to any other components of the oven door 5. The deflecting element 42 may be an optional component of the oven door 5, e.g., the deflecting element 42 may be installed in the oven door 5 or may be provided as an additional component, if requested. However, embodiments are not limited thereto and other configurations may be utilized. For example, in another embodiment, the deflecting element 42 can be integrated as part of the door structure. In one embodiment, the deflecting element 42 can be integrally molded as a monolithic unit with the remainder of the inner surface 12 of the door 5 and the door liner. In another embodiment, the deflecting element 42 can be permanently fixed to the inner surface 12 of the door 5, the door liner, and/or between the two lateral sides 44 and 46 of the door 5.

In a preferred embodiment, each of the channels 56 can have a respective base wall 51', 51" 51'" that is angled downward (when the door is vertical) toward the opposing lateral edges of the door 5. For example, the base walls 51', 51", 51'" can have a convex parabolic shape when viewed from the front or rear. Alternatively, they can have a substantially pyramid shape having a peak at the center of the door when viewed from the front or rear. In this configuration, liquid accumulated within the respective channels 56 will be guided toward the lateral edges of the door frame when the door 5 is pivoted to a vertical, closed position. Vertically extending ducts can be provided at the lateral edges of the door within its frame to conduct such liquid downward, through the door and out via base openings (not shown). Such liquid can collect on the floor underneath the base of the door. While this is not ideal, it can be preferred to collecting and accumulating permanently within the oven door 5, where collected liquids can contribute to undesirable characteristics and odors. In an alternative embodiment, a removable reservoir (or reservoirs—one for each of the lateral edges of the door) can be provided at the base of the door 5 for collecting liquid from the channels 56 when the door 5 is closed. The consumer then could remove, empty, clean and replace the reservoir(s) as needed or according to a schedule. This avoids the problem with pooled liquids on the floor of the kitchen at the base of the oven door.

As described above, the deflecting element 42 will inhibit spilled liquid that has penetrated the ventilation openings 22 from encountering and fouling the glass panels (34, 36, 38) and/or other components of the interior door structure when the door 5 is open, while still allowing airflow through the ventilation openings 22 for cooling the interior door components when the door 5 is closed.

Illustrative embodiments have been described, hereinabove. It will be apparent to those skilled in the art that the above apparatuses and methods may incorporate changes and modifications without departing from the general scope of this disclosure. The disclosure is intended to include all such modifications and alterations disclosed herein or ascertainable herefrom by persons of ordinary skill in the art without undue experimentation.

What is claimed is:

1. A door for a cooking appliance comprising:

an outer surface;

an inner surface opposite the outer surface, wherein the inner surface includes at least one ventilation opening in fluid communication with an air channel within the door; and a deflecting element disposed in the door between the inner surface and the outer surface and adjacent the at least one ventilation opening, said deflecting element comprising a plurality of deflecting blades, each of said plurality of deflecting blades comprising a deflector portion extending laterally in the door and a blade channel formed adjacent the deflector portion, wherein respective deflector portions of the plurality of deflecting blades are aligned with the at least one ventilation opening to guide liquid spilled therethrough into the respectively associated blade channels.

2. A door for a cooking appliance comprising:

an outer surface;

an inner surface opposite the outer surface, wherein the inner surface includes at least one ventilation opening in fluid communication with an air channel within the door; and a deflecting element disposed in the door between the inner surface and the outer surface and adjacent the at least one ventilation opening, said deflecting element comprising a plurality of deflecting blades associated with respective channels extending laterally in the door, wherein respective deflector portions of the deflecting blades are aligned with the at least one ventilation opening to guide liquid spilled therethrough into the respectively associated channels, said plurality of deflecting blades being tiered so that when the door is opened, spills received through the at least one ventilation opening can overflow a first one of the deflecting blades and encounter a subjacent one of the deflecting blades.

3. The door of claim 1, further comprising a plurality of glass panels installed in said door.

4. The door of claim 3, wherein at least one of the plurality of deflecting blades is aligned with at least one of the glass panels.

5. The door of claim 3, wherein the deflecting element further comprises elongated slots formed between adjacent deflecting blades.

6. The door of claim 5, wherein each of the elongated slots corresponds to at least one air channel between adjacent glass panels, such that air circulating through said at least one air channel can exit said at least one ventilation opening via an associated one of the elongated slots.

7. The door of claim 3, wherein at least a first one of said plurality of deflecting blades has an angled deflector portion.

8. The door of claim 7, wherein when the door is opened, spills received through the at least one ventilation opening are directed by the angled deflector portion to a subjacent one of said plurality of deflecting blades of the deflecting element.

9. The door of claim 1, wherein when the deflector portions have different lengths.

10. A door for a cooking appliance comprising:

an outer surface;

an inner surface opposite the outer surface, wherein the inner surface includes at least one ventilation opening in fluid communication with an air channel within the door; and a deflecting element disposed in the door between the inner surface and the outer surface and adjacent the at least one ventilation opening, said deflecting element comprising a plurality of deflecting blades associated with respective channels extending laterally in the door, wherein respective deflector portions of the deflecting blades are aligned with the at least one ventilation opening to guide liquid spilled therethrough into the respectively associated channels, wherein, when the door is rotated into an upright position as the door is closed spills received by each of the tiered deflecting blades are directed toward lateral edges of the door via the associated laterally extending channels.

11. The door of claim 10, each said channel having a base wall angled downward from a center thereof toward opposite lateral edges of the door.

12. A door for a cooking appliance comprising:

an outer surface;

an inner surface opposite the outer surface, wherein the inner surface includes at least one ventilation opening in fluid communication with an air channel within the door; and a deflecting element disposed in the door between the inner surface and the outer surface and adjacent the at least one ventilation opening, said deflecting element comprising a plurality of deflecting blades associated with respective channels extending laterally in the door, wherein respective deflector portions of the deflecting blades are aligned with the at least one ventilation opening to guide liquid spilled therethrough into the respectively associated channels, wherein the at least one ventilation opening remains unobstructed by the deflecting element.

13. The door of claim 11, each said base wall having a convex shape.

14. The door of claim 3, wherein geometry of the deflecting element inhibits spills from contacting and fouling glass panels within the door.

15. The door of claim 1, wherein the deflecting element is configured to be secured in the door without additional fasteners.

16. A cooking appliance comprising:

an oven cavity within a housing; and the door of claim 1 for closing the oven cavity.

* * * * *